US005956769A

United States Patent [19]

Stepney

[11] Patent Number: 5,956,769

[45] Date of Patent: Sep. 28, 1999

[54] SHIRT WITH SNAP FASTENED COLLAR POINTS

[76] Inventor: Richard Stepney, 1787 Peachwillow St., Pittsburg, Calif. 94565

[21] Appl. No.: 09/061,207

[22] Filed: Apr. 16, 1998

[51] Int. Cl.[6] ..... A41D 27/18

[52] U.S. Cl. ..... 2/129; 2/115

[58] Field of Search ..... 2/129, 60, 123, 2/124, 104, 105, 106, 115, 121, 122, 131, 132, 133, 139, 140, 141.1, 130, 134, 135, 136, 137, 138, 141.2, 142, 143; 24/572, 575, 576, 577, 578, 580, 588–593

[56] References Cited

U.S. PATENT DOCUMENTS

| | | | |
|---|---|---|---|
| 1,606,920 | 11/1926 | Bornstein | 2/139 |
| 2,774,075 | 12/1956 | Saccoccio | 2/106 |
| 3,860,967 | 1/1975 | Tedesco | 2/129 |
| 4,939,794 | 7/1990 | Aronson | 2/128 |
| 5,761,744 | 6/1998 | Horvat et al. | 2/129 |

FOREIGN PATENT DOCUMENTS

| | | | |
|---|---|---|---|
| 2043061 | 3/1972 | Germany | 2/140 |

*Primary Examiner*—Gloria Hale

[57] ABSTRACT

A shirt with snap fastened collar points for holding down in place the collar points of a plain collared shirt. The inventive device includes a shirt body having a front with a collar being coupled to said shirt body. A snap fastener is located on each of the collar points of the collar. Each snap fastener detachably couples the inner surface its associated collar point to the front of the shirt body.

1 Claim, 2 Drawing Sheets

SHIRT WITH SNAP FASTENED COLLAR POINTS

BACKGROUND OF THE INVENTION

1. Field of the Invention

The present invention relates to collared shirts and more particularly pertains to a new shirt with snap fastened collar points for holding down in place the collar points of a plain collared shirt.

2. Description of the Prior Art

The use of collared shirts is known in the prior art. More specifically, collared shirts heretofore devised and utilized are known to consist basically of familiar, expected and obvious structural configurations, notwithstanding the myriad of designs encompassed by the crowded prior art which have been developed for the fulfillment of countless objectives and requirements.

Known prior art collared shirts include U. S. Pat. Nos. 4,000,522; 5,375,302; 4,608,734; U.S. Pat. No. Des. 301, 567; U.S. Pat. Nos. 3,401,434; and 2,242,352.

While these devices fulfill their respective, particular objectives and requirements, the aforementioned patents do not disclose a new shirt with snap fastened collar points. The inventive device includes a shirt body having a front with a collar being coupled to said shirt body. A snap fastener is located on each of the collar points of the collar. Each snap fastener detachably couples the inner surface its associated collar point to the front of the shirt body.

In these respects, the shirt with snap fastened collar points according to the present invention substantially departs from the conventional concepts and designs of the prior art, and in so doing provides an apparatus primarily developed for the purpose of holding down in place the collar points of a plain collared shirt.

SUMMARY OF THE INVENTION

In view of the foregoing disadvantages inherent in the known types of collared shirts now present in the prior art, the present invention provides a new shirt with snap fastened collar points construction wherein the same can be utilized for holding down in place the collar points of a plain collared shirt.

The general purpose of the present invention, which will be described subsequently in greater detail, is to provide a new shirt with snap fastened collar points apparatus and method which has many of the advantages of the collared shirts mentioned heretofore and many novel features that result in a new shirt with snap fastened collar points which is not anticipated, rendered obvious, suggested, or even implied by any of the prior art collared shirts, either alone or in any combination thereof.

To attain this, the present invention generally comprises a shirt body having a front with a collar being coupled to said shirt body. A snap fastener is located on each of the collar points of the collar. Each snap fastener detachably couples the inner surface its associated collar point to the front of the shirt body.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new shirt with snap fastened collar points apparatus and method which has many of the advantages of the collared shirts mentioned heretofore and many novel features that result in a new shirt with snap fastened collar points which is not anticipated, rendered obvious, suggested, or even implied by any of the prior art collared shirts, either alone or in any combination thereof.

It is another object of the present invention to provide a new shirt with snap fastened collar points which may be easily and efficiently manufactured and marketed.

It is a further object of the present invention to provide a new shirt with snap fastened collar points which is of a durable and reliable construction.

An even further object of the present invention is to provide a new shirt with snap fastened collar points which is susceptible of a low cost of manufacture with regard to both materials and labor, and which accordingly is then susceptible of low prices of sale to the consuming public, thereby making such shirt with snap fastened collar points economically available to the buying public.

Still yet another object of the present invention is to provide a new shirt with snap fastened collar points which provides in the apparatuses and methods of the prior art some of the advantages thereof, while simultaneously overcoming some of the disadvantages normally associated therewith.

Still another object of the present invention is to provide a new shirt with snap fastened collar points for holding down in place the collar points of a plain collared shirt.

Yet another object of the present invention is to provide a new shirt with snap fastened collar points which includes a shirt body having a front with a collar being coupled to said shirt body. A snap fastener is located on each of the collar points of the collar. Each snap fastener detachably couples the inner surface its associated collar point to the front of the shirt body.

Still yet another object of the present invention is to provide a new shirt with snap fastened collar points that, unlike a traditional oxford style button down shirt, hides the fastener on the inner surface of the collar of the shirt so that the collar point is held down in place without showing the fastener, unlike a traditional button down shirt where the button is shown.

Even still another object of the present invention is to provide a new shirt with snap fastened collar points that uses a snap fastener to quickly and easily fasten the collar points down on a shirt.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
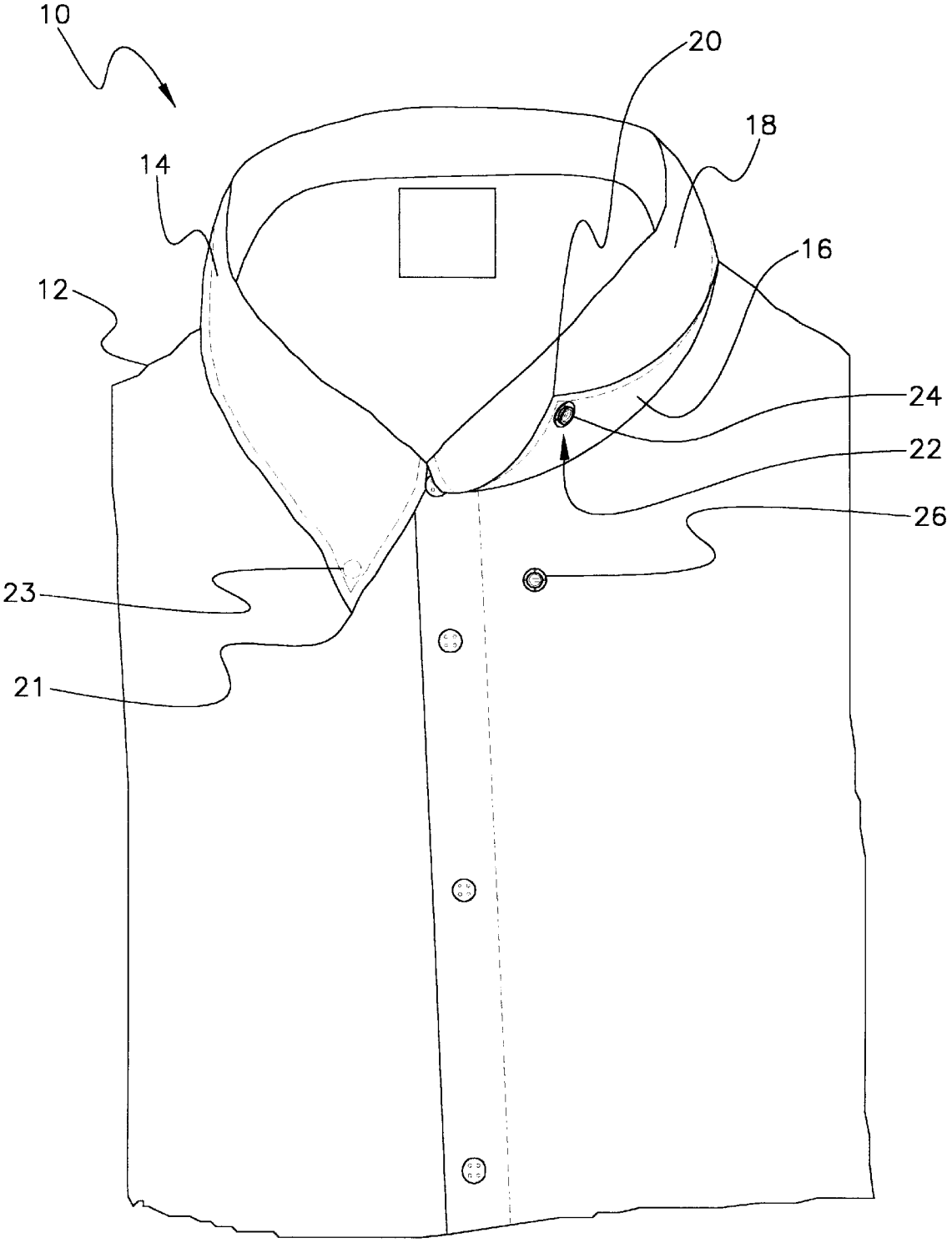
FIG. 1 is a schematic front side view of a new shirt with snap fastened collar points according to the present invention.
Figure 2:
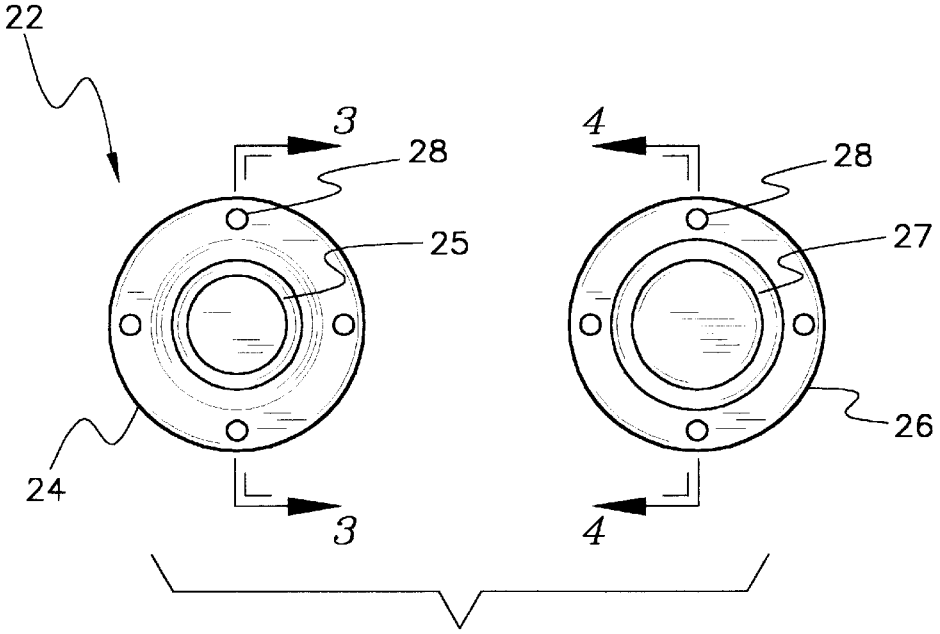
FIG. 2 is a schematic top side view of the portions of a snap fastener of the present invention.
Figure 3:
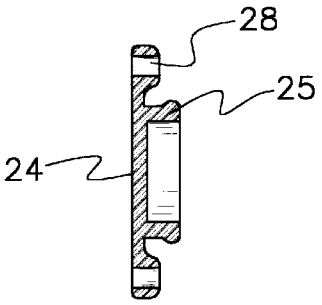
FIG. 3 is a schematic side view of a first portion of a snap fastener of the present invention taken from line 3—3 of FIG. 2.
Figure 4:
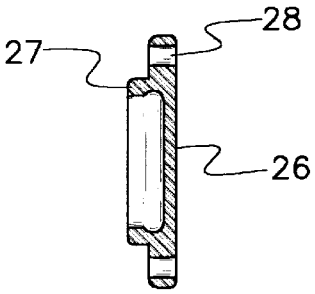
FIG. 4 is a schematic side view of a second portion of a snap fastener of the present invention taken from line 4—4 of FIG. 2.
Figure 5:
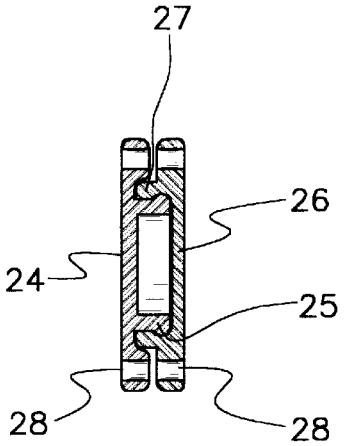
FIG. 5 is a schematic side view of the two portions of a snap fastener coupled together.

With reference now to the drawings, and in particular to FIGS. 1 through 5 thereof, a new shirt with snap fastened collar points embodying the principles and concepts of the present invention and generally designated by the reference numeral 10 will be described.

As best illustrated in FIGS. 1 through 5, the shirt with snap fastened collar points 10 generally comprises a shirt body 12 having a front with a collar 14 being coupled to said shirt body 12. A snap fastener 22,23 is located on each of the collar points 20,21 of the collar 14. Each snap fastener 22,23 detachably couples the inner surface 16 its associated collar point to the front of the shirt body 12.

In closer detail, the shirt comprises a shirt body 12 having a front and a back with a collar 14 coupled to the shirt body 12. The collar 14 has inner and outer surfaces 16,18 and a pair of opposite collar points 20,21. The inner surface 16 of the collar 14 is designed for folding over a tie and the neckband of the shirt. Preferably the collar 14 is constructed from inner and outer plies with the inner ply of the collar 14 defining the inner surface 16 and the outer ply defining the outer surface 18 of the collar 14.

A snap fastener 22,23 located on each collar point 20,21 is provided for detachably coupling the inner surface 16 of their associated collar point 20,21 to the front of the shirt body 12. With reference to FIGS. 2 through 5, each snap fastener 22,23 comprises a pair of detachably couplable complementary portions 24,26. The first portion 24 of each snap fasteners 22,23 is coupled (ideally stitched) to the inner ply of the collar 14 at of their associated collar point 20,21 such that the attachments of the first portions 24 are not visible from the outer surface 18 of the collar 14. The second portion 26 of each snap fastener 22,23 is coupled to the front of the shirt body 12 such that it is detachably couplable to its associated first portion 24 to hold its associated collar point 20,21 to the front of the shirt body 12. Preferably, each of the portions 24,26 of the snap fastener has a plurality of holes 28 for extending thread therethrough to stitch the portions 24,26 to their respective portion of the shirt.

Ideally, each portion has an annular fastening lip 25,27 extending from it The diameter of the lip 25 of the first portion is less than the diameter of the lip 27 of the second portion 26 so that the fastening lip 25 of the first portion 24 may be inserted into the space defined by lip 27 of the second portion 26 such that the fastening lip 25 of the first portion detachably engages the fastening lip 27 of the second portion. In the ideally embodiment, the diameters of the lips 25,27 of the snap fasteners 22,23 are less than about ¼ inch and ideally each lip extends outwards from their respective portion less than about ¼ inch.

In use, the shirt with snap fastened collar points 10 is designed for holding down in place the collar points of a plain collared shirt. Unlike a traditional oxford style button down shirt, hides the fastener on the inner surface of the collar of the shirt so that the collar point is held down in place without showing the fastener, unlike a traditional button down shirt where the button is shown. The snap fasteners allow a user to quickly and easily fasten the collar points down on a shirt.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A shirt, comprising:

a shirt body having a front and a back;

a collar being coupled to said shirt body, said collar having inner and outer surfaces, inner and outer plies, and a pair of opposite collar points, said inner surface of said collar being for folding over a tie and a neckband of the shirt, said inner ply of said collar defining said inner surface of said collar, said outer ply defining said outer surface of said collar;

a pair of snap fasteners, each said snap fastener being located on an associated collar point of said collar, each said snap fastener detachably coupling to said inner surface an associated collar point of said collar to said front of said shirt body;

each snap fastener comprising a pair of detachably couplable complementary portions;

a first of said portions of each of said snap fasteners being stitchedly coupled to said inner ply of said collar such that said snap fasteners are not visible from said outer surface of said collar; and a second of said portions of each of said snap fasteners being coupled to said front of said shirt body such that it is detachably couplable to its associated first portion to hold its associated collar point to said front of said shirt body;

wherein each of said portions of said snap fasteners has a radially extending annular flange with a plurality of holes formed therein about a circumference thereof for extending thread therethrough to stitch said portions of said snap fasteners to said shirt;

wherein said second portions of said snap fasteners each have an annular fastening lip extending therefrom with an annular indent formed about an inboard end of an inner surface thereof, said fastening lip of each second portion defining a space and having a diameter;

wherein said first portions of said snap fasteners each have an annular fastening lip extending therefrom with an annular detent formed about an outboard end of an outer surface thereof, said fastening lip of each first portion having a diameter, said diameter of each first portion being less than said diameter of each second portion, said fastening lip of each first portion being insertable into said space of one of said second portions such that said fastening lip of said first portion detachably engages said fastening lip of said second portion;

wherein said diameters of said snap fasteners are less than ¼ of an inch;

wherein said annular flange of each first portion of said snap fasteners has an annular groove formed about said annular fastening lip thereof for receiving said annular fastening lip of one of said second portions.

* * * * *